US005156308A

United States Patent [19]

Aoyama

[11] Patent Number: 5,156,308

[45] Date of Patent: Oct. 20, 1992

[54] LIQUID SUPPLY DEVICE FOR A DEVELOPING UNIT USING A LIQUID DEVELOPER

[75] Inventor: Yuichi Aoyama, Tokyo, Japan

[73] Assignee: Ricoh Company, Ltd., Tokyo, Japan

[21] Appl. No.: 647,351

[22] Filed: Jan. 29, 1991

[30] Foreign Application Priority Data

| | | | |
|---|---|---|---|
| Jan. 31, 1990 | [JP] | Japan | 2-21375 |
| Mar. 2, 1990 | [JP] | Japan | 2-51179 |
| Mar. 2, 1990 | [JP] | Japan | 2-51180 |
| Nov. 29, 1990 | [JP] | Japan | 2-333362 |

[51] Int. Cl.[5] ..... B67D 5/60

[52] U.S. Cl. ..... 222/145; 222/325; 222/479; 222/509; 222/514; 222/DIG. 1

[58] Field of Search ..... 222/145, 325, 402.1, 222/504, 509, 514, 479, DIG. 1

[56] References Cited

U.S. PATENT DOCUMENTS

| | | | |
|---|---|---|---|
| 4,561,759 | 12/1985 | Knott | 222/DIG. 1 X |
| 4,722,461 | 2/1988 | Symmank | 222/509 X |
| 4,860,924 | 8/1989 | Simms et al. | 222/DIG. 1 X |
| 5,042,693 | 8/1991 | DeLuca | 222/479 X |

FOREIGN PATENT DOCUMENTS 0306217 3/1989 France .

*Primary Examiner*—Gregory L. Huson

*Attorney, Agent, or Firm*—Oblon, Spivak, McClelland, Maier & Neustadt

[57] ABSTRACT

A device for supplying a liquid developer from a toner container to a tank and from the tank to a developing unit of which is operable with the liquid developer. The nozzle hole of the toner container is open into a circulation path along which the liquid developer is circulated. Hence, the nozzle hole is constantly dipped in the liquid developer without regard to the liquid level in the tank and, therefore, is free from the deposition of dried toner particles.

7 Claims, 9 Drawing Sheets

LIQUID SUPPLY DEVICE FOR A DEVELOPING UNIT USING A LIQUID DEVELOPER

BACKGROUND OF THE INVENTION

1. Field of the Invention

The present invention relates to a device for supplying a liquid developer from a toner container to a tank and from the tank to a developing unit which is operable with the liquid developer.

2. Discussion of the Background

A liquid developer supply device of the type described has a tank storing a liquid developer, a toner container mounted on the tank upside down, and a dispersant bottle also mounted on the tank in an upside down manner. A pump is disposed in the tank for compressing the liquid developer. The liquid developer, i.e., a mixture of toner ejected from the toner container and dispersant fed from the dispersant bottle is fed by the pump to a developing unit or a cleaning unit through a supply conduit and is returned to the tank by a return conduit. The liquid level in the tank is sensed by a float switch. A nozzle having an inlet port and a nozzle hole is affixed to the mouth of the toner container. When the toner container is mounted on the tank, the inlet port of the nozzle is opened to feed the toner from the container into the tank via the nozzle hole. The dispersant fed from the dispersant bottle is mixed with the toner to form the liquid developer. The toner container mounted on the tank is usually positioned such that the nozzle hole of the nozzle is dipped in the liquid in the tank. Should the liquid level become lower than the nozzle hole of the nozzle, the nozzle hole would be exposed to the atmosphere and stopped by the toner which would dry and deposit on the nozzle then. However, the problem is that the liquid level in the tank is not always constant since the developer consumption and the amount of developer fed to and returned from the developing unit are not constant. It, therefore, often occurs that the nozzle hole of the nozzle is exposed to the atmosphere due to the fall of the liquid level. Then, the toner dries and sticks to the nozzle to stop the nozzle hole.

The above problem will be eliminated if the nozzle hole of the nozzle remains in the liquid even when the liquid level in the tank is changed. For this purpose, the toner container may be provided with an extremely long nozzle or may be bodily located in a lower position, as proposed in the past. However, a toner container having a long nozzle is not easy to handle and apt to break the nozzle when dropped. Lowering the position of a toner container is not desirable since the container would be dipped in and wetted by the liquid over substantial part thereof and, therefore, not easy to handle.

SUMMARY OF THE INVENTION

It is therefore an object of the present invention to provide a liquid supply device which prevents the nozzle hole of a nozzle of a toner container from being stopped up by dried toner particles.

It is another object of the present invention to provide a generally improved liquid supply device for a developing unit of the type using a liquid developer.

A device for supplying a liquid developer to a developing unit operable with the liquid developer of the present invention comprises a tank storing a liquid developer, a toner container filled with a toner and removably mounted on the tank, a nozzle affixed to a mouth of the toner container and having a nozzle hole, an opening and closing mechanism for opening and closing the nozzle, a pump disposed in the tank for feeding the liquid developer to the developing unit, and a circulation path for circulating the liquid developer from and to the pump. The nozzle hole is open into the circulation path.

BRIEF DESCRIPTION OF THE DRAWINGS

The above and other objects, features and advantages of the present invention will become more apparent from the following detailed description taken in connection with the accompanying drawings in which.

DESCRIPTION OF THE PREFERRED EMBODIMENT

Figure 1:
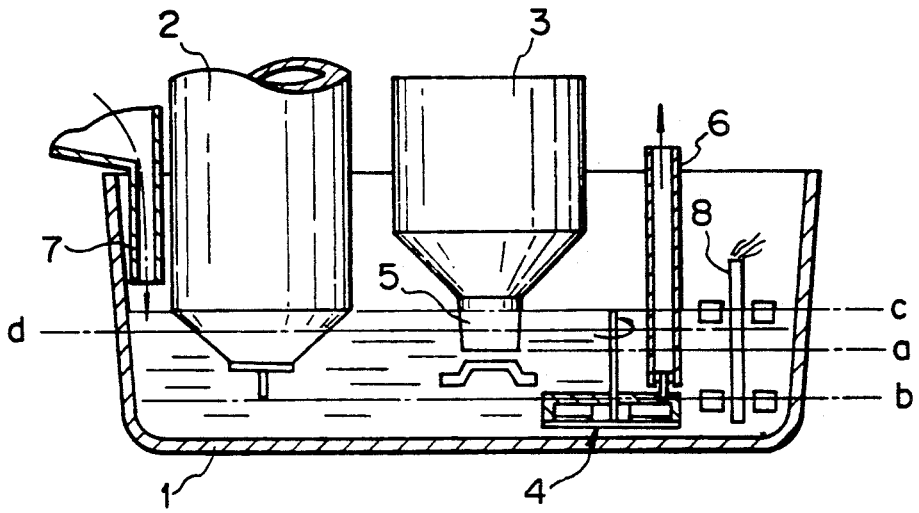
Fig. 1 PRIOR ART
FIG. 1 is a sectional view showing a conventional liquid supply device for a conventional developing unit using a liquid developer.
Figure 2:
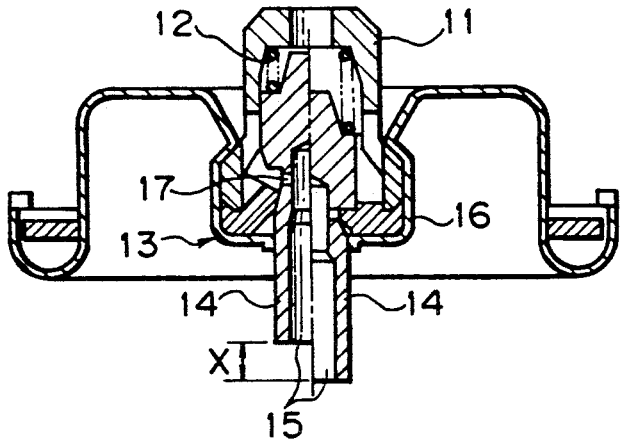
Fig. 2 PRIOR ART
FIG. 2 is a sectional showing the mouth of a toner container of the device of FIG. 1.

To better understand the present invention, a brief reference will be made to a conventional liquid supply device, shown in FIG. 1. As shown, the liquid supply device has a liquid tank 1, a toner container 2 disposed in the liquid tank 1 upside down, and a dispersant bottle 3 also disposed in the tank 1 upside down and having a chicken feed valve 5. A pump 4 compresses a mixture of a dispersant and a toner fed into the tank 1 from the dispersant bottle 3 and toner container 2, respectively. The mixture, or liquid developer, under pressure is fed from the pump 4 to a developing unit by a supply conduit 6. The liquid developer is returned from the developing unit to the tank 1 by a return conduit 7. A float switch 8 is responsive to the level of the liquid in the tank 1. The toner container 2 may have a first chamber which is expansible by a supply of gas and a second chamber which contrasts on the expansion of the first chamber and accommodates the toner therein, as disclosed in Japanese Utility Model Laid-Open Publication No. 125457/1989. As shown in FIG. 2 specifically, the toner container 2 has a cylindrical mouth 13, and a housing 11 disposed in the mouth 13. A nozzle 14 is slidably received in the housing 11 and constantly biased by a spring 12 toward the outside of the housing 11. The nozzle 14 has an inlet port 17. As shown in the right-hand side of the figure, when the nozzle 14 is held in a protruded position, a seal valve 16 seals the inlet port 17. As shown in the left-hand side of the figure, when the nozzle 14 is raised by a supply mechanism which will be described, the seal valve 16 is deformed so as to open the inlet port 17 with the result that the interior of the toner container 2 is fluidly communicated to the tank 1.

When the dispersant bottle 3 filled with a dispersant is set in the tank 1 which is empty at first, the dispersant is fed into the tank 1 until it reaches a stable level a. Then, the inlet port 17 of the toner container 2 is opened to supply toner into the tank 1 through a nozzle hole, 15, FIG. 2. When a predetermined toner concentration is set up in the tank 1 as monitored by a concentration sensor, the toner supply is stopped. During copying operation, the pump 4 feeds the liquid developer to the developing unit or a cleaning unit through the supply conduit 6. The liquid developer circulated through such units are returned to the tank 1 by the return conduit 7. Therefore, it takes a certain period of time for the liquid developer fed out from the tank 1 to return to the tank 1. In the meantime, the liquid level in the tank 1 becomes lower than the stable level a with the result that the chicken feed valve 5 is actuated to supply the dispersant from the bottle 3.

As the copying operation is repeated a number of times, the toner, which is solid matter, and the dispersant both are consumed and, therefore, supplied. When the dispersant bottle 3 runs out of the dispersant, the liquid level in the tank 1 falls to a lower limit b. Conversely, when documents of the kind carrying images over a substantial area thereof are reproduced, only the toner is consumed while the amount of dispersant is increased with no regard to the toner. As a result, the liquid level in the tank 1 sequentially rises and, in due course, reaches an upper limit c. In this manner, the liquid level changes between the lower limit b and the upper limit c. When the copying operation is completed and the machine is stopped, the liquid developer having been fed to the developing unit is returned to the tank 1 so as to raise the liquid level in the tank to a level d. The increment of the liquid level from a to d, i.e., d−a is generally referred to as a trapped amount.

Since the liquid level in the tank 1 constantly changes as stated above, the nozzle hole 15 of the nozzle 14 of the toner container 2 is apt to be exposed to the atmosphere unless the toner container 2 is accurately set in the toner tank 1. Then, the toner would dry and stick to the nozzle hole 15 to obstruct the subsequent supply of toner.

Figure 3:
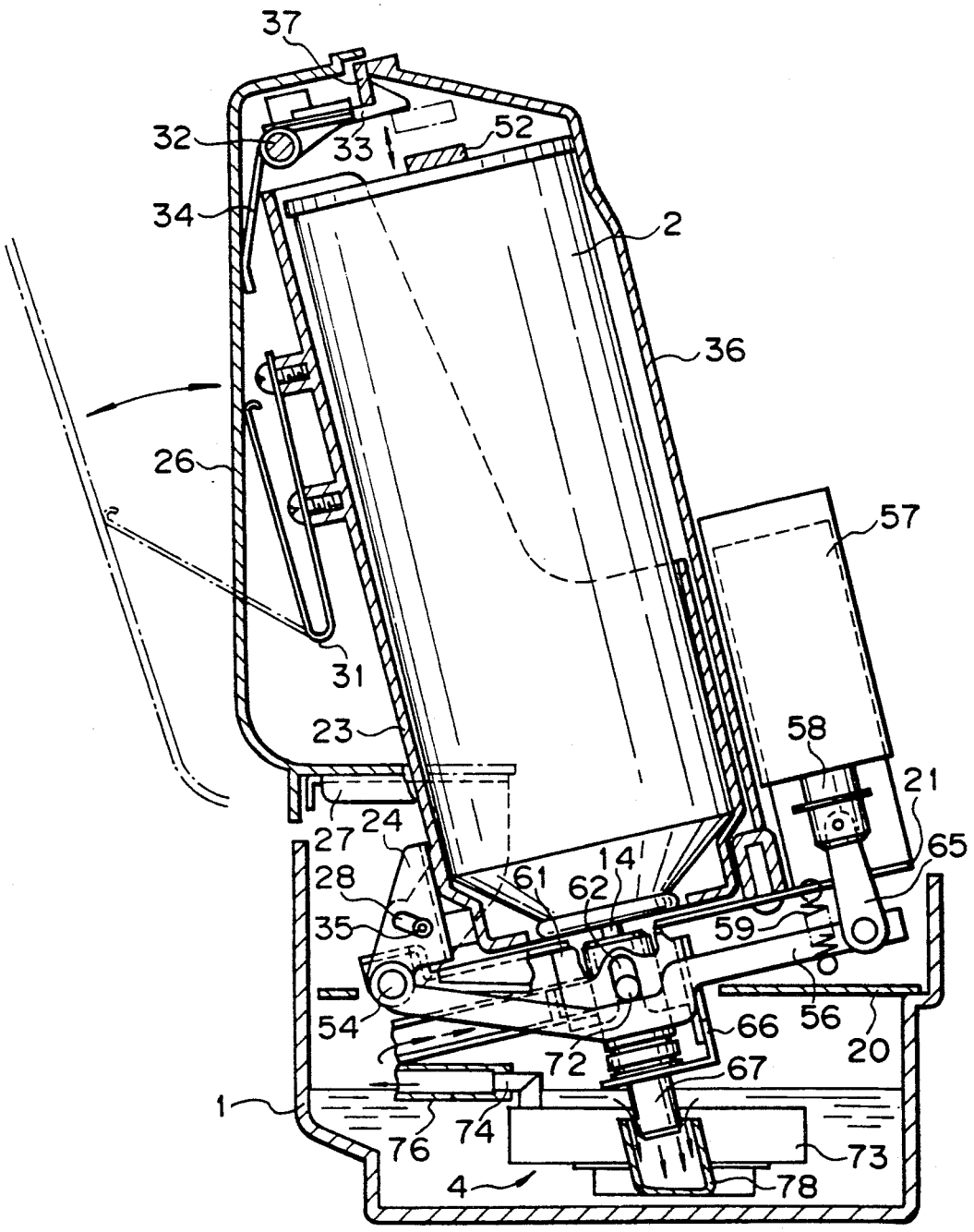
FIG. 3 is a fragmentary sectional view of a liquid supply device embodying the present invention.
Figure 4:
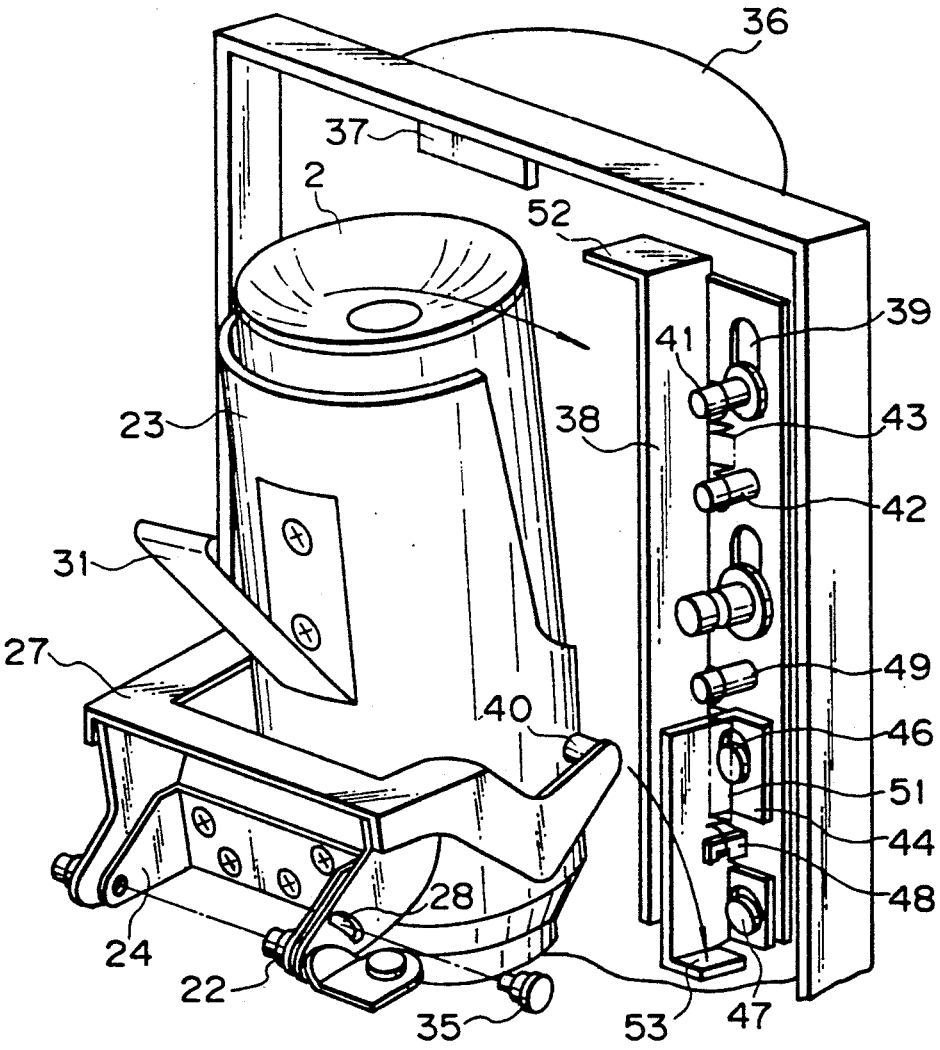
FIG. 4 is an exploded perspective view showing part of the preferred embodiment.

Referring to FIGS. 3 and 4, a liquid supply device embodying the present invention is shown which is free from the problem particular to the prior art device as discussed above. In the figures, the same or similar components and structural elements are designated by like reference numerals, and redundant description will be avoided for simplicity. As shown, a flat base 20 is affixed to a tank 1 in the vicinity of the open end of the tank 1. A flat support 21 is mounted on the base 20 with an inclined position. An inner holder 23 receives a toner container 2 therein and has a bracket 24 which is rotatably mounted on the support 21 by a pivot shaft 22. A front cover 26 has a bracket 27 which is also rotatably mounted on the support 21 by the pivot shaft 22. A pin 35 is studded on the bracket 24 and slidably received in an arcuate slot 28 which is formed through the bracket 27, as illustrated. A pin 40 is studded on the tip of an arm extending rearward from the bracket 27. A spring 31 is affixed to the outer surface of the inner holder 23 that faces the inner surface of the front cover 26. A pivot shaft 32 is mounted on an upper portion of the front cover 26 and protrudes to the outside at one end thereof. A knob, not shown, is affixed to the protruding end of the pivot shaft 32. A hook 33 is mounted on the pivot shaft 32 and constantly biased by a spring 34 counterclockwise as viewed in FIG. 3.

A rear cover 36 is mounted on the support 21 to face the front cover 26. The rear cover 36 has at the upper end thereof an engaging portion 37 engageable with the hook 33. As shown in FIG. 4, a presser plate 38 is mounted on the rear cover 36 adjacent to one of opposite sides of the latter. The presser plate 38 is movable up and down and, for this purpose is formed with two vertically extending slots 39 in an upper portion thereof. Guide pins 41 are threaded into the rear cover 36, and each is slidably received in a respective one of the slots 39. A first tension spring 43 is anchored at one end to the upper guide pin 41 and at the other end to a pin 42 studded on the presser plate 38 and located below the guide pin 41. An auxiliary presser plate 44 is mounted on a lower portion of the presser plate 38 so as to be movable up and down. Specifically, two vertically spaced slots 46 are formed through the auxiliary presser plate 44, while guide pins 47 threaded into the presser plate 38 are slidably received in the slots 46. A second tension spring 51 exerting a greater force than the first tension spring 51 is anchored at opposite ends thereof to a lug 48 disposed between the slots 46 and a pin 49 which is studded on the pressure plate 38. The presser plate 38 has a pressing portion 52 at the upper end thereof, and the auxiliary presser plate 44 has a pressure receiving portion 53 at the lower end thereof.

The support 21 supports a pivot shaft 54 adjacent to one end thereof and a solenoid 57 adjacent to the other end thereof. The pivot shaft 54 is positioned coaxially with the pivot shaft 22. The solenoid 57 has a plunger 58 and is mounted upside down on the support 21. An arm 56 is mounted on the pivot shaft 54 at one end thereof and connected to the plunger 58 of the solenoid 57 by a link 65 at the other end thereof. A tension spring 59 is peloaded between the arm 56 and the support 21.

Figure 5:
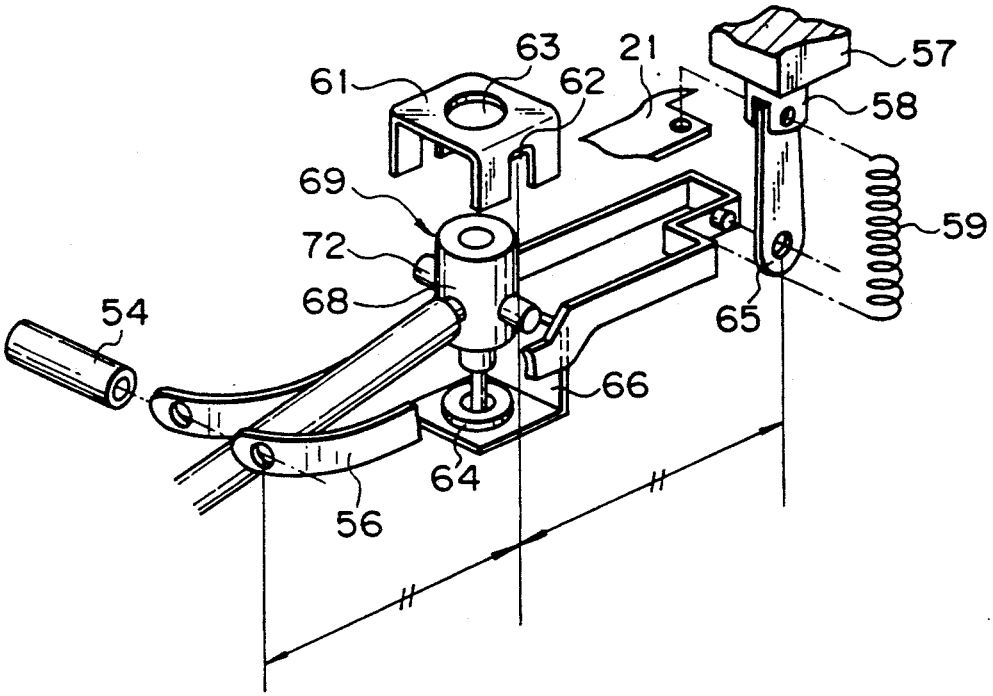
FIG. 5 is a perspective view showing another part of the preferred embodiment.
Figure 7:
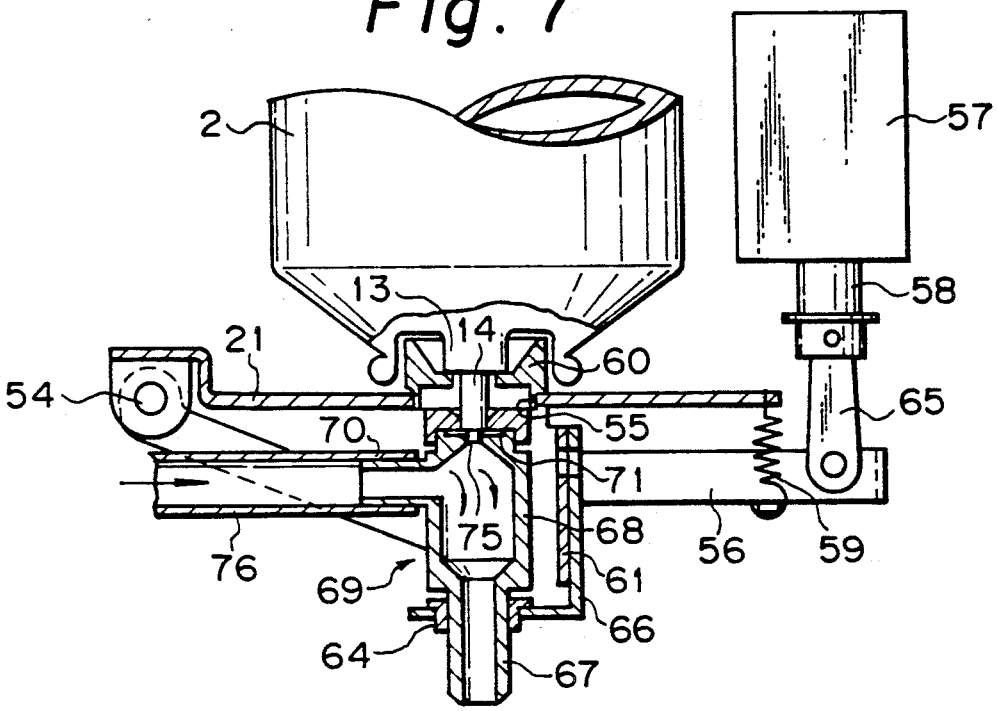
FIG. 7 is a section showing another part of the preferred embodiment in a condition wherein a toner is not jetted out.

The support 21 has an opening 55 (FIG. 7) substantially at the center thereof. A seat 60 for receiving the mouth 13 of the toner container 2 is received in the opening 55. A guide piece 61 is mounted on the underside of the support 21. As shown in FIG. 5, the guide piece 61 having a bottom-open box-like configuration are formed with a circular opening 63 and bottom-open slots 62 at the center and the side walls, respectively. A generally L-shaped guide piece 66 has an upright extension which is affixed to a side wall of the guide piece 61 which is perpendicular to the arm 56. As also shown in FIG. 5, the guide plate 66 has an opening in the bottom wall thereof and a flexible packing 64 in the opening.

Figure 6:
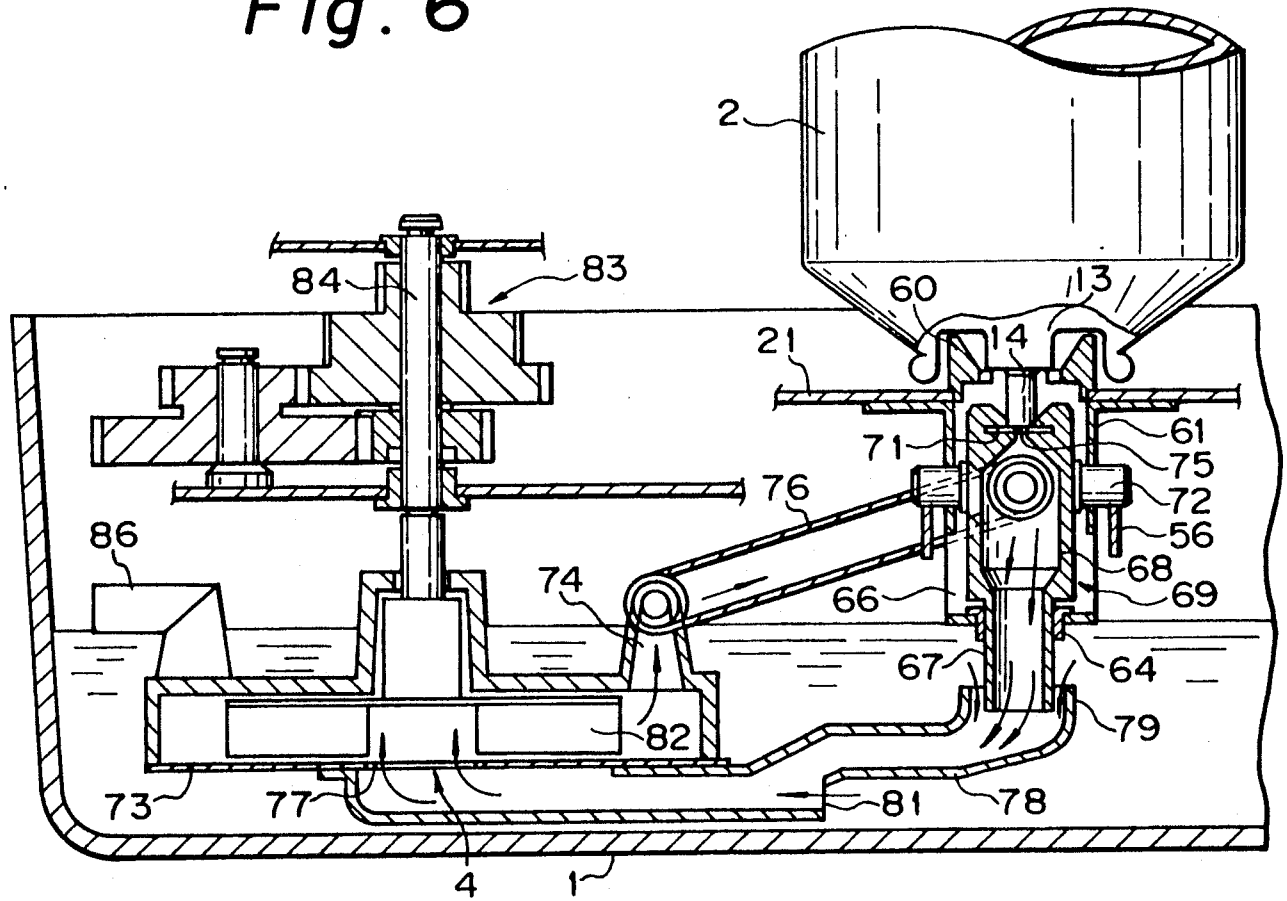
FIG. 6 is a vertical section showing another part of the preferred embodiment.
Figure 9:
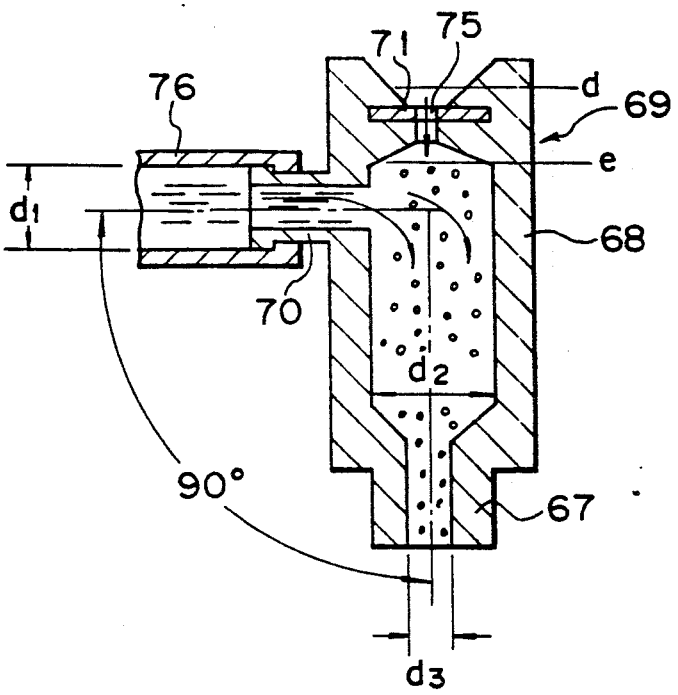
FIG. 9 is a section showing a joint member included in the preferred embodiment.

As shown in FIG. 6, a joint member 69 is mounted on the bottom wall of the guide piece 66 and has an outlet tube 67 and a hollow joint body 68 disposed above the outlet tube 67. The outlet tube 67 is removably received in the packing 67. As shown in FIG. 9, an inlet tube 70 extends out substantially perpendicularly from one side of the joint body 68. A packing 71 is attached to the top of the joint body 68 to abut against the tip of the nozzle 14 of the toner container 2. An opening 75 formed through the packing 71 provides fluid communication between the nozzle hole 15 of the nozzle 14 and the interior of the joint body 68. A guide pin 72 extends out from the joint body 58 in a radial direction which is perpendicular to the inlet tube 70. The guide pin 72 is received in the slots 62 of the guide piece 61 and rests on the upper edge of the arm 56.

As shown in FIG. 6, a pump 4 has a casing 73 and an outlet tube 74 extending upward from the casing 73. A supply conduit 76 communicates the outlet tube 74 to the inlet tube 70 of the joint member 69. A liquid inlet 77 is formed through the center of the bottom wall of the casing 73. A return conduit 78 communicates the liquid inlet 77 to the outlet tube 67 of the joint member 69. These conduits and tubes form a liquid circulation path in cooperation. The return conduit 79 has a liquid inlet 79 coupled over the outlet tube 67 and having a greater diameter than the tube 67. An opening 78 is formed in an intermediate portion of the return conduit 79 for a purpose which will be described hereafter. A rotor 82 is disposed in the casing 73 and connected to a shaft 84 which is rotated by a drive member, not shown, via a gearing 83. Reference numeral 86 designates a supply conduit extending to a developing unit, not shown.

To mount a new toner container 2, the shaft 32 is rotated to rotate the hook 33 clockwise as viewed in FIG. 3 so as to release the hook 33 from the engaging portion 37. Then, the front cover 26 is rotated about the shaft 22, shown in FIG. 4, to a position indicated by a phantom line in FIG. 3. As a result, the inner holder 23 and the used toner container 2 supported by the inner holder 23 are rotated in the same direction as the front cover 26 due to the arcutate slot 28 and pin 35. In this condition, the used toner container 2 is removed from the inner holder 23, a new toner container 2 is inserted in the inner holder 23, and then the front cover 26 is rotated in the opposite or closing direction.

When the movement of the front cover 26 in the closing direction is about to end, the inner holder 23 rises relative to the support 21 under the action of the spring 31. Then, the front cover 26 reaches the phantom line position shown in FIG. 3 while compressing the spring 31. As soon as the inclined surface of the hook 33 moves past the engaging portion 37, the hook 33 is automatically locked by the engaging portion 37.

While the front cover 26 is moved toward the closed position mentioned above, the pin 40, shown in FIG. 4, studded on the tip of the arm of the front cover bracket 27 abuts against and urges the pressure receiving portion 53 of the auxiliary presser plate 44. As a result, the presser plate 38 is lowered against the action of the first spring 43 until the pressing portion 52 thereof abuts against the top of the toner container 2. As the pin 40 moves further downward, the lug 48 of the auxiliary presser plate 44 urges the pin 49, i.e., the presser plate 38 downward through the second spring 51 with the result that the toner container 2 is further pressed by the pressing potion 52. Consequently, the mouth 13 of the toner container 2 is caused to tightly contact with the seat 60 of the joint member 69, while the tip of the nozzle 14 is brought into tight contact with the packing 71. In this condition, the nozzle hole 15 of the nozzle 14 and the opening 75 of the packing 71 are communicated with each other. At this instant, as shown in the right-hand side of FIG. 2, the nozzle 14 is protruded downward to close the inlet port 17 thereof.

As stated above, the toner container 2 is initially set by the inner holder 23 which is rotatable about the shaft 22. Then, the tip of the nozzle 14 is moved vertically downward after it has become parallel to the surface of the packing 71. Hence, the two surfaces are allowed to tightly and uniformly contact each other.

To supply a toner from the toner container 2, the solenoid 57 is energized to lift the arm 56, as will be described in detail later. Hence, providing the operating stroke of the solenoid 57 with an excessive margin is not desirable. Since the length of the nozzle 14 generally differs from one toner container to another, the toner container 2 is supported by the support 21 at the mouth 13 thereof. While the height also differs from one toner container to another, it can be firmly supported by the pressing portion 52 under the action of the second spring 51 with no regard to the scattering in height.

As shown in FIG. 9, the interface between the tip of the nozzle 14 and the packing 71 of the joint member 69 is positioned slightly above the stable liquid level d or the support 21. When the pump 4 is operated, the liquid developer is fed to the developing unit by the supply conduit 86 and, at the same time, a circulating flow is generated through the outlet tube 74, supply conduit 76, joint member 69, and return conduit 78. As a result, the liquid developer partly overflows the joint member 69 via the opening 75 in the upper portion of the joint body 68, whereby the nozzle hole 15 and packing 71 are wetted.

Since the packing 71 is located in a particular level as stated above, the packing 71 remains in the liquid even when the toner container 2 is removed, thus preventing air from entering through the packing 71. Otherwise, when the liquid being circulated by the pump 4 is not of a great enough amount to overflow through the packing 71, the liquid level will be lowered from the stable level d to a leve e lower than the packing 71 so as to allow air to enter through the packing 71. The air would reach the pump 4 to lower the pressure of the liquid and, therefore, the pumping ability.

To cause the liquid to overflow through the opening 75 of the packing 71, the joint member 69 is provided with a unique configuration, as shown in FIG. 9. Assuming that the supply conduit 76, joint member 68 and outlet tuber 67 have inside diameters of d1, d2 and d3, respectively, the diameter d3 is selected to be greater than the diameter d1 to achieve the above object. On the other hand, the diameter d2 is selected so as to be greater than the diameter d1. This is because when the toner jets out a moment from the toner container 2 into the joint body 68 through the opening 75 of the packing 71, the volume of the joint member has to be close to or greater than the amount of a single jet. Otherwise, the interior of the joint body 68 would be blocked by the toner and would not be unblocked despite the liquid coming in through the supply tube 76.

The opening 81, FIG. 6, formed in the return conduit 78 insures a sufficient amount of liquid despite that the pump 4 feeds the liquid not only to the joint member 69 but also to the developing unit, concentration sensor, etc. It is to be noted that the opening 81 is not located in the position where the axis of the outlet tube 67 and the return conduit 78 intersect each other, thereby preventing the liquid from leaking to the return conduit 78.

The manner in which the toner is supplied from the toner container 2 to the tank 1 is as follows. When a concentration sensor sends a command as in the conventional device, the solenoid 57 is energized so as to rotate the arm 56 about the shaft 57. The arm 56 on which the guide pin 72 of the joint member 69 rests moves the joint member 69 upward. At this instant, the joint member 69 is allowed to rise vertically since its lower portion moves in the opening 79 of the return conduit 78 without any resistance and since its upper portion is supported by the packing 64.

Figure 8:
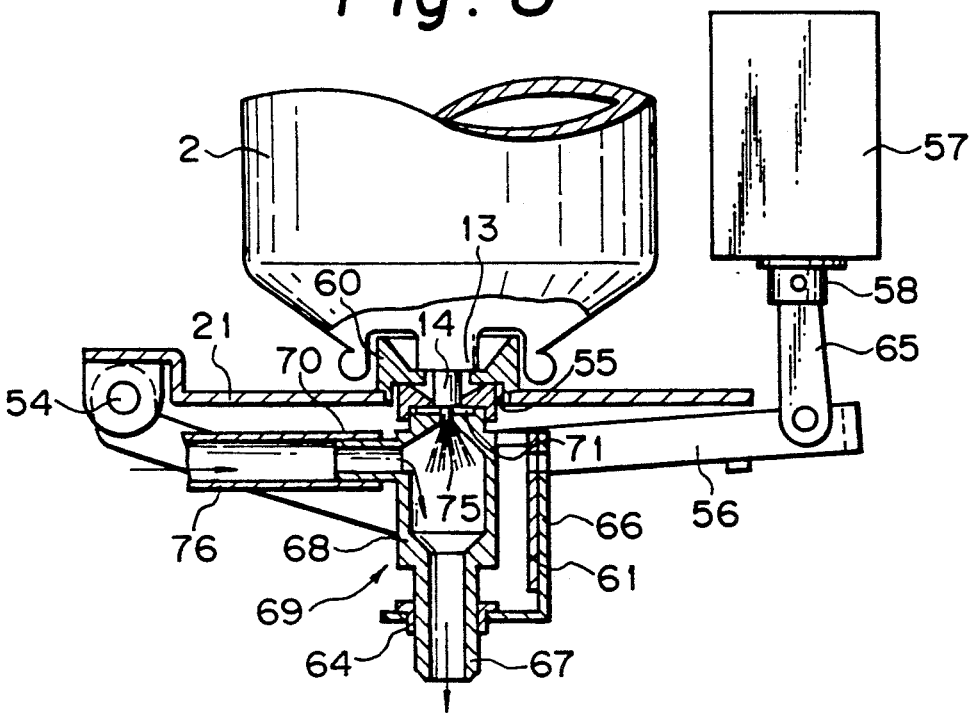
FIG. 8 is a section similar to FIG. 7, showing the part of interest in a toner jetting condition.
Figure 10:
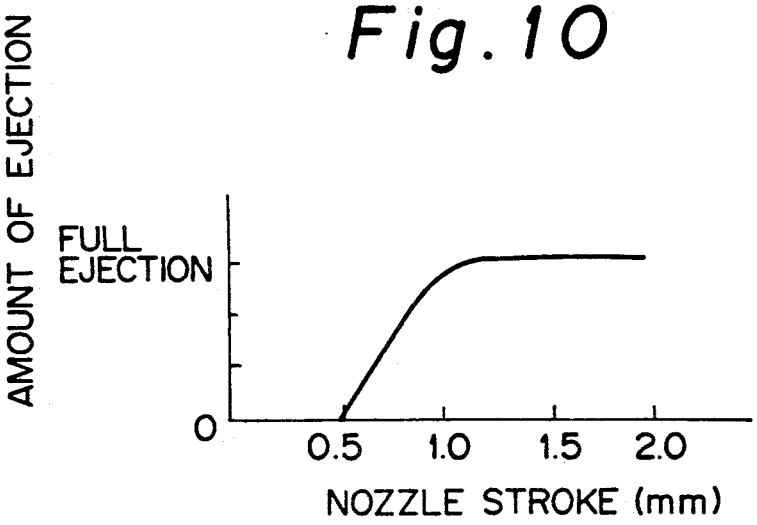
FIG. 10 is a graph showing the relation between the nozzle stroke and the amount of a jet of toner particular to the preferred embodiment.

The joint member 69 moving upward as mentioned above urges the nozzle 13 of the toner container 2 upward. As a result, the inlet port 17 of the nozzle 13 is opened to jet toner for a moment into the joint member 69 through the openings 15 and 75. FIG. 10 is a graph showing a relation between the stroke of the nozzle 14 and the amount of a jet of toner. As shown, the inlet port 17 begins to open when the stroke X, as shown in FIG. 2, of the nozzle 14 reaches 0.5 mm and then fully opens (see FIG. 8) when the stroke slightly exceeds 1 mm.

Figure 11:
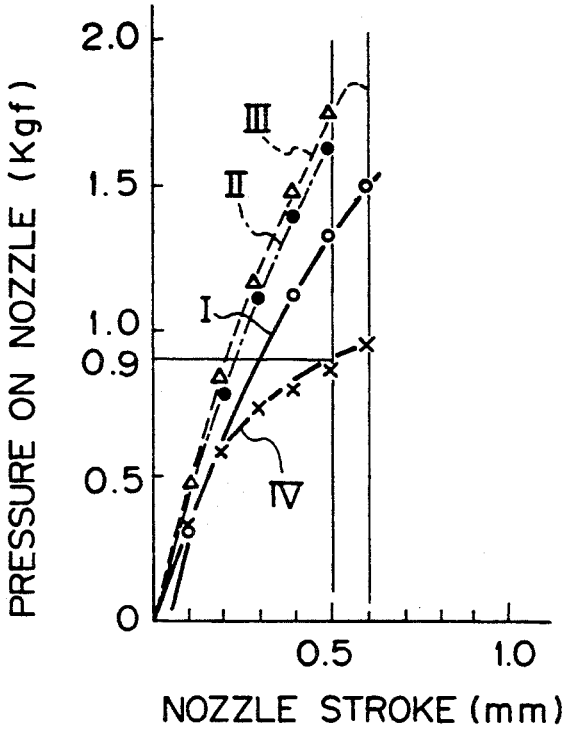
FIG. 11 is a graph showing the relation between the nozzle stroke and the pressure acting on the nozzle.

FIG. 11 shows the specific relations of nozzle stroke, pressure acting on the nozzle, and the pressure acting on the valve of the toner container, which were measured by use of toner containers each having a different internal pressure. In the figure, curves I, II and III are associated with toner containers whose respective internal pressures were 6.4 $kg/cm^2$, 9.2 $kg/cm^2$, and 10.0 $kg/cm^2$. Curve IV indicates pressures acting on the valve.

Regarding the nozzle stroke of 0.5 mm at which the inlet port 17 begins to open, the pressure acting on the valve is about 0.9 kgf. Hence, considering this pressure and the arm ratio, the inlet port 17 will not open even if the arm 56 is held by the spring 59 which exerts the same force on the nozzle. In light of this, the force of the spring 59 is selected to cope with the respective weight of arm 56 and joint member 69, the movement resistance of the supply conduit 76, the weights of the solenoid plunger 58 and link 65, plus 0.9 kgf. This is successful preventing the inlet port 17 from opening, i.e., maintaining in the packing 71 in tight contact with the opening 15 of the nozzle 14 when the solenoid 57 is not energized (see FIG. 7). Since the plunger 58 is constantly biased by the spring 59 toward the solenoid 57, the chatter of the link 65 or even the scattering in the position of the solenoid 57 is absorbed and, in addition, the solenoid 57 needs a minimum of force.

Figure 12:
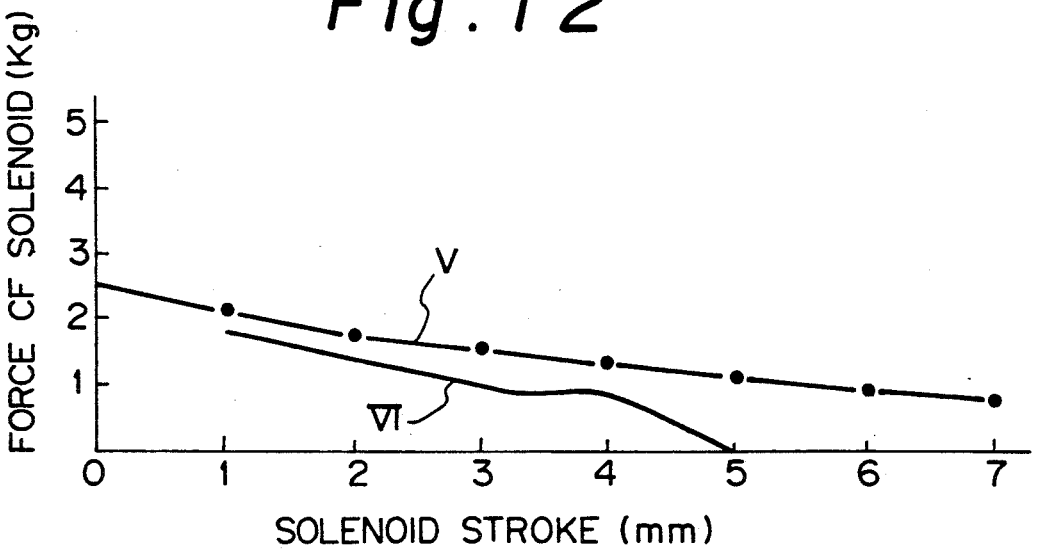
FIG. 12 is a graph showing the relation between the leverage of a lever and the force of a solenoid.

FIG. 12 shows the relation between the leverage of an opening and closing lever and the force of a solenoid with respect to a toner container having an internal pressure of 10 $kg/cm^2$ and a nozzle stroke of 2.5 mm. In the figure, a curve V indicates the force of the solenoid while a curve VI indicates the force measured when the distance between the shaft 54 and the guide pin 72 and the distance between the guide pin 72 and the link 65 were the same.

The defective supply of toner is ascribable not only to the toner drying and sticking to the nozzle hole 15 of the toner container 2, but also to the configuration of the joint member 69 expected to eliminate such an occurrence. Specifically, although the toner may be prevented from sticking to the nozzle hole 15 of the toner container 2, the highly viscous toner blocked the bore of the joint body 68 would obstruct toner supply as the toner stopping the outlet 15.

Figure 13:
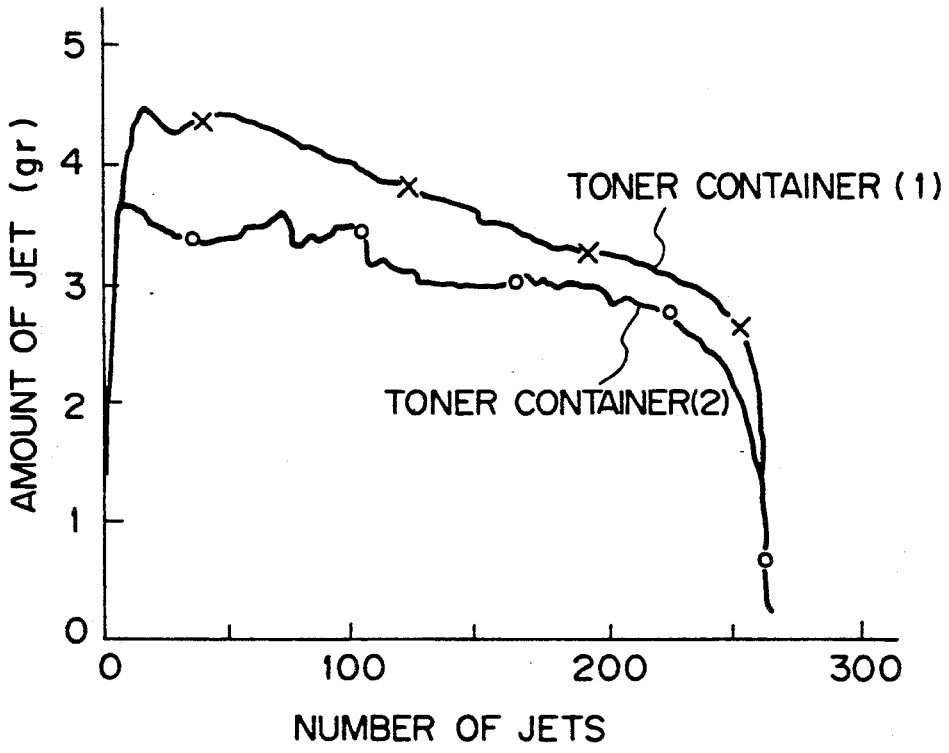
FIG. 13 is a graph showing the relation between the number of times that a toner is jetted out and the amount of each jet.

FIG. 13 is a graph showing a relation between the number of jets of toner and the amount of each jet particular to two different toner containers (1) and (2).

The conclusion derived from the various data described above is that assuming that the volume of the bore of the joint body 68 is V, and the maximum amount of toner jet is V1, V1 should be greater than V which in turn should be greater than V1/2. If V1 is greater than V, the liquid pressure inside the bore of the joint member 69 will not be lowered even when the toner container 2 is not set. Then, air is prevented from entering through the opening 75 and, therefore, from disabling the pump 4 even if the amount of liquid supply to the joint member 69 is not increased.

If V is greater than V1/2, the liquid is prevented from being ejected through the opening 75 when the toner container 2 is not set, even if the amount of liquid supply is not reduced. Should V be greater than V1/2, the toner would block the bore of the joint body 68 when the amount of toner jet is close to the maximum value V1.

In the joint body 68, the inlet tube 70 and outlet tube 67 are respectively located at the side and the bottom at an angle of substantially 90 degrees to each other. This, coupled with the fact that the opening 75 and outlet tube 67 are substantially coaxial causes the toner ejected from right to be washed away to a position below by the liquid incoming the joint body 68 sideways and thereby prevents it from staying in the joint body 68.

In summary, in accordance with the present invention, the nozzle hole of a nozzle of a toner container is open into a path along which a liquid developer is circulated from and to liquid supply means within a tank. Hence, the nozzle hole constantly remains in the liquid with no regard to the liquid level in the tank and is thereby prevented from being stopped by dried toner particles. The opening and closing means is constantly urged by biasing means against the inlet port of the nozzle. This prevents the inlet port from opening when not expected to do so and thereby allowing air to enter through the inlet port. Such air would reach the liquid supply through the circulation path to lower the ability of the latter. Also, when the liquid supply means is not operated, the circulation path is prevented from becoming empty, thereby exposing the nozzle hole to air. Otherwise, the toner would dry and stick to the nozzle hole.

A joint member has an opening which is constantly held in tight contact with the nozzle hole of the nozzle of a toner container by biasing means when the latter is set. The joint member forms part of the circulation path. Hence, the nozzle hole is constantly dipped in the liquid that fills the joint member, with no regard to the operation of the liquid supply means or the liquid level in the tank. This is also successful in preventing dried toner particles from stopping up the nozzle hole. Even when a toner container is not set, air is prevented from entering through the opening of the joint member since the liquid supply means continuously circulates the liquid through the circulation path. In addition, since the opening of the joint member is located above the liquid level of the tank, the body of a toner container is not wetted by the liquid.

The nozzle hole of a toner container is held in tight contact with the opening of the joint member. The liquid from the liquid supply means enters the bore of the joint body of the joint member sideways via an inlet tube. Toner ejected from the nozzle hole of the toner container into the bore of the joint body is mixed with the developer and then circulated to the liquid supply means via an outlet tube disposed below the joint body.

Since the outlet tube has a smaller diameter than the inlet tube, the liquid partly overflows through the opening of the joint member to wet the nozzle hole and thereby prevents the toner from drying or stopping up the nozzle opening. Again, air is prevented from entering through the opening of the joint member so as to degrade the pumping ability of the liquid supply means.

The outlet tube of the joint member has a smaller inside diameter than the bore of the joint body, and the volume V of the bore is smaller than the maximum amount of toner jet V1 and greater than V1/2. This, coupled with the fact that the opening of the joint member and the outlet tube disposed below the opening are substantially coaxial, inhibits air from entering the joint member even when the amount of liquid supply to the joint member is not increased. When the toner container is not set, the liquid is prevented from jetting through the opening of the joint member while the bore of the joint member is prevented from being stopped by the toner.

Various modifications will become possible for those skilled in the art after receiving the teachings of the present disclosure without departing from the scope thereof.

What is claimed is:

1. A device for supplying a liquid developer to a developing unit operable with said liquid developer, comprising:

a tank storing a liquid developer;

a toner container filled with a toner and removably mounted on said tank;

a nozzle affixed to a mouth of said toner container and having a nozzle hole;

opening and closing means for opening and closing said nozzle;

liquid supply means disposed in said tank for feeding said liquid developer to said developing unit; and circulation means for circulating said liquid developer along a path from said liquid supply means to said opening and closing means and back from said opening and closing means to said liquid supply means, said nozzle hole being open into said liquid circulation path.

2. A device as claimed in claim 1, further comprising biasing means for biasing said opening and closing means such that said opening and closing means and said nozzle hole remain in tight contact with each other when said toner container is mounted on said tank.

3. A device as claimed in claim 1, wherein said opening and closing means comprises a joint member forming part of said circulation means and having an opening.

4. A device as claimed in claim 3, further comprising biasing means for causing said nozzle hole to face and tightly contact said opening of said joint member.

5. A device as claimed in claim 4, wherein said opening of said joint member is disposed above a liquid level of said tank, said liquid supply means supplying said liquid developer even when said toner container is not mounted on said tank.

6. A device as claimed in claim 1, wherein said circulation means comprises a liquid supply conduit and a return conduit each communicating with said liquid supply means, and a joint member located between said supply conduit and said return conduit, said joint member comprising a hollow cylindrical joint body forming part of said opening and closing means, said joint body comprising an inlet tube located at a side and to which said supply conduit is connected and an outlet tube disposed below said inlet tube and having a smaller inside diameter than said inlet tube, said return conduit being connected to said outlet tube, said joint body further comprising an opening which, when said nozzle hole of said toner container is set in an upper portion of said joint body, communicates with said nozzle.

7. A device as claimed in claim 6, wherein said outlet tube has a smaller inside diameter than a bore formed in said joint body, said outlet tube and said opening of said joint body being substantially coaxial, and said bore having a volume V which is smaller than a maximum amount V1 of a jet of toner from said toner container and greater than V1/2.

* * * * *